US008919601B2

(12) United States Patent
Bobrov et al.

(10) Patent No.: US 8,919,601 B2
(45) Date of Patent: Dec. 30, 2014

(54) PRESSURE-MOTION COMPENSATING DIAPHRAGM FOR CONTAINERS

(75) Inventors: Sergey B. Bobrov, Aurora, IL (US); Mark D. Schneider, St. Charles, IL (US); Samuel E. Evins, Olathe, KS (US); Kerry W. Silvers, Campbellsburg, IN (US)

(73) Assignee: Graham Packaging Company, L.P., York, PA (US)

( * ) Notice: Subject to any disclaimer, the term of this patent is extended or adjusted under 35 U.S.C. 154(b) by 362 days.

(21) Appl. No.: 13/024,497

(22) Filed: Feb. 10, 2011

(65) Prior Publication Data

US 2012/0205339 A1 Aug. 16, 2012

(51) Int. Cl.

| | |
|---|---|
| ***B65D 1/32*** | (2006.01) |
| ***B65D 51/16*** | (2006.01) |
| ***B65D 55/02*** | (2006.01) |
| ***B65D 79/00*** | (2006.01) |

(52) U.S. Cl.

CPC ..... *B65D 79/005* (2013.01)
USPC ..... 220/721; 220/203.01; 215/211

(58) Field of Classification Search

CPC ..... B65D 79/005
USPC ..... 220/721, 203.01, 203.11, 203.18, 220/203.24, 203.25, 234, 237; 215/211, 215/212, 216, 271, 270, 349
See application file for complete search history.

(56) References Cited

U.S. PATENT DOCUMENTS

| | | | | |
|---|---|---|---|---|
| 2,027,438 | A * | 1/1936 | Karl | 220/258.3 |
| 3,930,592 | A * | 1/1976 | Dilanni | 220/270 |
| 4,135,635 | A * | 1/1979 | Fujii et al. | 220/721 |
| 4,174,784 | A * | 11/1979 | Hartung | 215/349 |
| 4,199,752 | A * | 4/1980 | Lucas et al. | 340/388.2 |
| 4,398,491 | A * | 8/1983 | Fridl et al. | 116/67 R |
| 4,765,498 | A * | 8/1988 | Rafferty | 215/230 |
| 4,998,638 | A * | 3/1991 | Kawamata | 220/626 |
| 5,100,009 | A * | 3/1992 | Thompson et al. | 215/341 |
| 5,152,412 | A * | 10/1992 | Iler | 215/230 |
| 5,853,096 | A | 12/1998 | Bartur et al. | |
| 6,068,154 | A * | 5/2000 | Grabher | 220/256.1 |
| 6,179,139 | B1 * | 1/2001 | Heilman | 215/230 |
| 6,182,850 | B1 | 2/2001 | Marbler et al. | |
| 7,832,579 | B2 * | 11/2010 | Lohrman et al. | 215/256 |
| 2004/0256348 | A1 * | 12/2004 | Stevens et al. | 215/262 |

(Continued)

FOREIGN PATENT DOCUMENTS

| | | |
|---|---|---|
| WO | WO 2006/053013 | 5/2006 |

*Primary Examiner* — Bryon Gehman
*Assistant Examiner* — Shawn M Braden
(74) *Attorney, Agent, or Firm* — Stradley Ronon Stevens & Young, LLP

(57) ABSTRACT

A pressure-motion compensating diaphragm for air and liquid tight sealing, in combination with a cap, of a container. The diaphragm has (1) an edge engaging at least one of the cap and the container, and positioning the diaphragm horizontally in the container proximate the neck of the container and under the cap; (2) a center deflector button; and (3) a plurality of silfon tori segments extending from the edge to the center deflector button. The dimensions and geometries of the edge, center deflector button, and tori segments are predetermined to compensate uniquely for forces applied to the diaphragm and created by pressure changes inside and outside the container that occur as the container is filled with a product and processed through filling, pasteurization, or cooling steps. Also provided is an apparatus including the cap, the container, and the diaphragm for releasably storing the product.

20 Claims, 11 Drawing Sheets

(56) References Cited

U.S. PATENT DOCUMENTS

2007/0131644 A1 6/2007 Melrose
2007/0228058 A1* 10/2007 Brown ..... 220/796
2008/0044603 A1* 2/2008 Hutchinson et al. ..... 428/35.7
2008/0083693 A1* 4/2008 Gottlieb et al. ..... 215/12.2
2009/0101620 A1* 4/2009 O'Brien ..... 215/270
2009/0179032 A1* 7/2009 Livingston ..... 220/254.7

* cited by examiner

PRESSURE-MOTION COMPENSATING DIAPHRAGM FOR CONTAINERS

TECHNICAL FIELD

The present invention relates generally to closures for containers and, more particularly, to a closure diaphragm for containers—especially containers that are hot-filled or pasteurized—that responds to the differential pressure inside of the container by partially absorbing stresses derived from the pressure and partially translating forces into motion via deflection.

BACKGROUND OF THE INVENTION

Plastic containers are widely used in many applications requiring thermal stability up to about 185° F. while maintaining the physical integrity of the container. In some applications, however, the package must be processed at even higher temperatures. Low-acid packaging applications frequently require, for example, processing temperatures above 200° F. Still other applications require processing temperatures at or above the boiling point of water (about 212° F.). Such elevated-temperature processing may contribute to intensive evaporation of the liquid stored in the container, expansion of the contained gases that develop at the elevated pressures, or both. The pressures that develop can vary from positive pressure (above atmospheric) upon heating to vacuum during and after cooling, conveying, and storing processes. Cooling processes can be performed at or near the freezing point of water (32° F.) and even at subzero temperatures.

Conventional plastic containers exposed to such conditions can distort by bulging and can implode during cooling. The distorted container often loses its ability to seal and maintain air and liquid-tight closure due to distortion of the container finish. The distorted container also loses its shape noticeably enough that labeling and printing on the surface of the container are rendered difficult, if not impossible. In addition to these functional drawbacks, the distorted container loses its aesthetic consumer appeal.

To overcome the problems identified above, many conventional containers have panels, indented handles, ripples, and stiffeners of various forms. These components increase the weight and the cost of the container, and substantially reduce the area on the container available for labels and print. It is also a common practice to increase the wall thickness in order to stiffen the container. This practice often leads, during packaging operations, to partial or full heat-induced crystallization of the polymer used to make the container. Such crystallization leaves the container pearlescent or opaque, irreversibly and adversely affects the structural integrity of the container, and detracts from the consumer appeal of the container. Several patents and published patent applications have also tried to address the problems identified above. Samples of those patents and applications are summarized below.

In U.S. Patent Application Publication No. 2008/0083693, Gottlieb et al. describe a flexible membrane that is movable in response to a change in pressure inside a bottle, allowing for pressure equalization as the bottle cools. The cap for the bottle has an outer cap and an inner cap, with the flexible membrane positioned in and attached to the inside of the inner cap. An air-tight seal is formed between the flexible membrane and the bottle rim when the cap is attached to the bottle. The inner cap has an aperture allowing air to enter the area between the flexible membrane and the cap. The flexible membrane remains attached to the cap when the cap is on the container or is removed. Although the disclosed device compensates for the vacuum developed in the container during cooling, its complexity is economically prohibitive and it provides an entrance path for bacteria into the space under the cap.

In U.S. Patent Application Publication No. 2007/0131644, Melrose describes a container, intended for filling with a hot liquid, and a headspace sealing and displacement method for removing vacuum pressure. The container has a neck finish with an opening closed by a primary seal which has an expandable side wall. As the liquid cools, the side wall is drawn into the container to remove vacuum pressure created within the container. A permanent cap can provide a secondary seal for the container and define a secondary headspace between the primary and secondary seals. In other embodiments, the primary seal can be replaced by a mechanically movable seal which may be locked in its downward position. The secondary seal can also have a port or an aperture to provide access into the secondary headspace for a commodity such as a tablet or pill. The container disclosed by Melrose has multiple components, and the disclosed method requires two or three independent operations. Moreover, the container and method do not sufficiently compensate for the positive pressure created during filling and closing operations.

Marbler et al. teach closure membranes for containers in U.S. Pat. No. 6,182,850. The membranes include a number of functional layers, some punctured to allow the pressure in the interior of the container to be adjusted to the atmosphere. A chemical organic material, such as hot melt, paraffin, wax, or the like, softens under the influence of heat and closes the punctured layers during hot fill or pasteurization operations. Alternatively, in another stage of the manufacturing operation, the membrane can be completely sealed. Although the closure membranes compensate for the positive pressure during the filling operation, they provide an entrance for bacteria to enter the under-cap space and fail to compensate for either positive or negative pressure after sealing and during the life of the product.

Bartur et al. disclose a pressure-equalizing and foam-eliminating cap for a container in U.S. Pat. No. 5,853,096. The cap is specifically designed to accommodate liquids and vapors at higher-than-atmospheric pressure. The disclosed cap relates to bottle caps which allow for pressure equalization at opening and which eliminate the release of a mixture of gas and liquid from the interior of the container upon opening. The cap works well for pressures above atmospheric, such as in packaging of carbonated beverages and where user intervention is present to safely open the container. The rigidity of the construction renders the cap less well suited, however, to compensate for the vacuum pressure generated during processing of hot-fill and pasteurizable containers.

In U.S. Pat. No. 4,174,784, Hartung discloses an anti-collapse cap. The device prevents the inward deformation of a hollow plastic container which would normally inwardly deform after closure due to the cooling of hot liquids in the container. The device has a membrane with peaks and valleys extending across the container spout to seal the spout. The membrane is formed of a single unitary piece of flexible material that is more flexible than the walls of the container. The ambient pressure on the outside of the container is applied to the outside of the surface of the membrane. The device disclosed by Hartung is expandable and inwardly deforms when, after sealing, there is a pressure reduction within the container. Although the disclosed cap compensates for the vacuum which occurs in the container after cooling, the cap would be inefficient under the high temperature and pressure in hot fill and pasteurizing applications where excessive internal pressure develops due to the evaporation of fluids in the container.

In their International Publication No. WO 2006/053013, Trude at el. describe a moveable seal for a hot-fill or pasteurizable container. The seal moves in response to pressure changes in the container and has a number of collapsible vertical bellows that can be folded next to one another to extend into the container or toward the closure depending on the pressure inside the container. The moveable portion of the seal can take the shape of ribs or concentric circles that are placed throughout the entire device. The Trude et al. seal is a pressure-compensating device that can respond to either positive or negative pressure, but requires an expensive multi-step folding operation during manufacture. For high-temperature applications, the seal requires an additional dip-annealing operation to assure a spring-like response. Such an operation would make the device economically infeasible. Further, the bellows construction has a vertical configuration that limits the range of motion for the seal. Still further, although it is particularly suitable for long-to-medium neck containers, the seal has structural limitations in short neck and extra wide-mouth container applications. Finally, the disclosed seal consumes container volume that might otherwise be designated for the product retained inside the container.

Many, if not all, of the devices described in the patents and applications summarized above have a variation of a vent hole which presents the risk of tampering with the product. Many of the devices are too complex to economically manufacture. Others are designed to equalize excessive pressure or vacuum but not both. Some devices consume a substantial amount of container volume. Others are vertically activated, presenting an opportunity for the device to collapse under vacuum or high-pressure pasteurization.

Therefore, there remains a need in the art for an improved container closure diaphragm that responds to the differential pressure inside of the container by translating forces into motion via deflection. The present invention provides an apparatus that meets this need and overcomes the shortcomings of the current solutions. The present invention also provides an apparatus that meets the related need for an economical and efficient way to adapt presently available standard containers with a variety of necks and finishes and standard caps as a part of a packaging solution. It is a principal object of the present invention to provide an apparatus that can be hot filled or pasteurized. A related object is to provide an apparatus that compensates equally for both the high pressure and vacuum conditions that occur during hot-fill and pasteurizing processes. Another object is to protect containers and caps from varying pressures at elevated temperatures and after cooling. Still another object is to provide an apparatus that does not consume a substantial amount of container volume designated for the product.

BRIEF SUMMARY OF THE INVENTION

To achieve these and other objects, and to meet these and other needs, and in view of its purposes, the present invention provides a pressure-motion compensating diaphragm for air and liquid tight sealing, in combination with a cap, of a container. The diaphragm has three main components: an edge, a center deflector button, and a plurality of silfon tori segments. The edge engages at least one of the cap and the container, positioning the diaphragm horizontally in the container proximate the neck of the container and under the cap. The plurality of silfon tori segments extend from the edge to the center deflector button. The dimensions and geometries of the edge, center deflector button, and tori segments are predetermined to compensate uniquely for forces applied to the diaphragm and created by pressure changes inside and outside the container that occur as the container is filled with a product and processed through filling, pasteurization, or cooling steps.

Also provided is an apparatus for releasably storing a product. The apparatus includes a container having a neck, a top, and a vertical centerline, and houses the product with the product having a top level. The cap engages the container to help form an air and liquid tight seal. The diaphragm (as described generally above and in more detail in the remainder of this document) is disposed in the container to help form the air and liquid tight seal. The apparatus defines a first chamber between the cap and the diaphragm, a second chamber between the diaphragm and the top level of the product, and a head space between the top level of the product and the top of the container. The diaphragm has a predetermined design to displace a certain amount of the head space in its neutral position and another amount of the head space when fully engaged.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
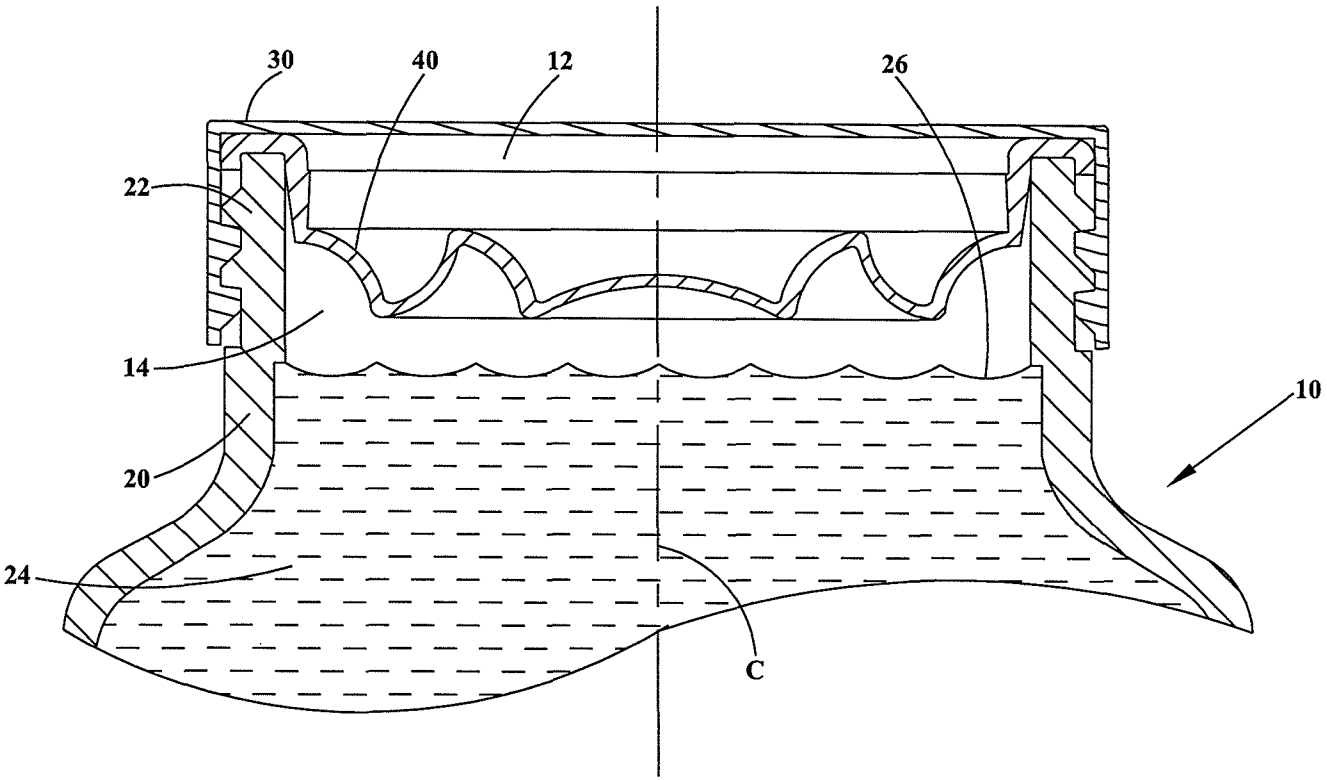
FIG. 1 is a cross-sectional view illustrating an example of a diaphragm in combination with a container and a cap in accordance with the present invention.

The present invention is directed to a closure diaphragm that can be inserted into containers. In one example embodiment, the diaphragm is a silfonic stress-strain reactive horizontal pressure compensating insertion that translates stress from pressure to motion, and absorbs and equalizes both positive and negative pressure varying in a plastic container during all steps of conversion including filling, pasteurization, and cooling operations. The silfonic stress-strain compensating insertion is particularly useful in hot-fill and pasteurizable applications during which the container is heated, or the product in the container is heated, using media such as steam, water, or air.

Whether it be a silfonic diaphragm, a silfonic tube (known in the industry as an undulate sack), or another silfonic configuration, a silfonic element in general is a device specifically designed to readily respond to varying temperatures and pressures in a vessel with ease and accuracy dictated by the application and influenced by the structure to be protected. By their action, silfonic elements are translating devices. Silfonic elements absorb and transfer stresses derived from varying temperature and pressure inside of equipment, a vessel, or packaging into volumetric displacement of the value required to equalize the raised or reduced pressure to the level that the elements of the container and closure can sustain without deformation, and in accordance with the particular application.

In their article titled "Experimental Researches About Achievement of a Protection Valve with Silfonic Tube, for Burning Installation with Gas," R. Gheorghe and B. Vasilica of the University of Targu Jiu describe, in part, the principle of silfonic compensation. The authors disclose a vertically oriented undulate sack or tube made of metal (CuSn) having thin walls (0.6 mm). The silfonic tube is placed in, and protects, a valve designed to control the feed of flame burner gas in a combustion plant. The tube is filled with siliconic oil and transfers or converts temperature variations into linear movement. The silfonic elements according to the present invention are fundamentally different, from the silfonic tube disclosed in the article, in the way they react to the varying forces and pressures. The elements of the inventive diaphragm are disposed horizontally and are designed to readily absorb and translate forces into a specified three-dimensional motion.

Overview of the Invention

The closure diaphragm can be combined with a standard cap to form part of a closure mechanism for a wide-mouth container, bottle, or pouch. The closure mechanism provides a reliable air and liquid-tight seal able to withstand the elevated temperatures characteristic of hot-fill and pasteurization operations. The diaphragm compensates for both elevated pressure and vacuum generated inside of the container, bottle, or pouch by absorbing stress and translating stress into motion. The diaphragm also provides a physical barrier against the ingress of fluids, and adds a gas-scavenging capability to the closure mechanism. Additional application functionality can also be achieved through various modifications of the diaphragm.

The diaphragm is a three-dimensional architecture constructed of a single-layer or multi-layered plastic. Preferably, the plastic used to construct the diaphragm has multiple layers. At least one layer is made of a thermoplastic elastomer to promote sealability, at least one layer is a physical barrier against the ingress of fluids, and at least one layer is a polymer that carries a gas scavenger or a combination of gas scavengers. The diaphragm has a resin that may include exothermic or endothermic blowing agents or a combination of such, or any other functional additives—fillers, colorants, biocides, or others—suitable for a particular application. Other example layers that may be included in forming the diaphragm are tie layers and layers bearing images, decorations, and advertisements. The central portion of the diaphragm is specifically formed by injection molding, co-injection molding, compression over-molding, thermoforming, or vacuum-assist thermoforming—or by or combination of such processes.

The material of the diaphragm may or may not be more flexible than the material of the container or the cap, again depending upon the application. The material and configuration of the diaphragm are selected to enable the diaphragm to react to the loads anticipated inside of the container, by transferring tensile or compression loads into bending and rotating forces that readily deflect the diaphragm with minimum resistance. Thus, the diaphragm provides reactive dynamic compensation to a container and a cap assembly.

Embodiments of the Invention

Referring now to the drawing, in which like reference numbers refer to like elements throughout the various figures that comprise the drawing, FIG. 1 illustrates an example of a combination cap-container-diaphragm apparatus 10 in accordance with a first embodiment of the present invention. The apparatus 10 includes a conventional plastic container 20 such as a bottle, jar, jag, or pouch. Typically, although not necessarily, the container 20 has a neck 22 with a threaded finish. The container 20 is constructed to hold or retain a product 24, typically a liquid and occasionally a liquid and gas.

The apparatus 10 further includes a conventional cap 30 made of a plastic, metal, or a combination of such materials. The cap 30 often has a threaded finish that engages with the threaded finish on the neck 22 of the container 20. Such engagement helps to provide a tight seal between the container 20 and the cap 30 when the user screws the cap 30 onto the container 20.

The apparatus 10 still further includes a pressure-motion compensating closure diaphragm 40. The diaphragm 40 is horizontally disposed in the container 20 proximate the neck 22 of the container. As shown, the diaphragm 40 is located above the top level 26 of the product 24 and does not adversely impact the volume available to hold the product 24. The diaphragm 40 is positioned underneath the cap 30 so that, as shown in FIG. 1, the diaphragm sits between the container 20 and the cap 30. The diaphragm 40 may be affixed if desired either to the container 20 or to the cap 30. Alternatively, the diaphragm may be a loose component that is held between the container 20 and the cap 30 when the container 20 and the cap 30 are engaged.

The apparatus 10 defines two, separate chambers. A first or upper chamber 12 is defined between the cap 30 and the diaphragm 40. A second or lower chamber 14 is defined between the diaphragm 40 and the top level 26 of the product 24 retained in the container 20. The "head space" of the container 20 is the area between the top level 26 of the product 24 and the top of the container 20, and is approximately equal to the combination of the first chamber 12 plus the second chamber 14. All three components (namely, the container 20, the cap 30, and the diaphragm 40) of the apparatus 10 are typically (although not necessarily) symmetrical about a centerline "C."

Figure 2:
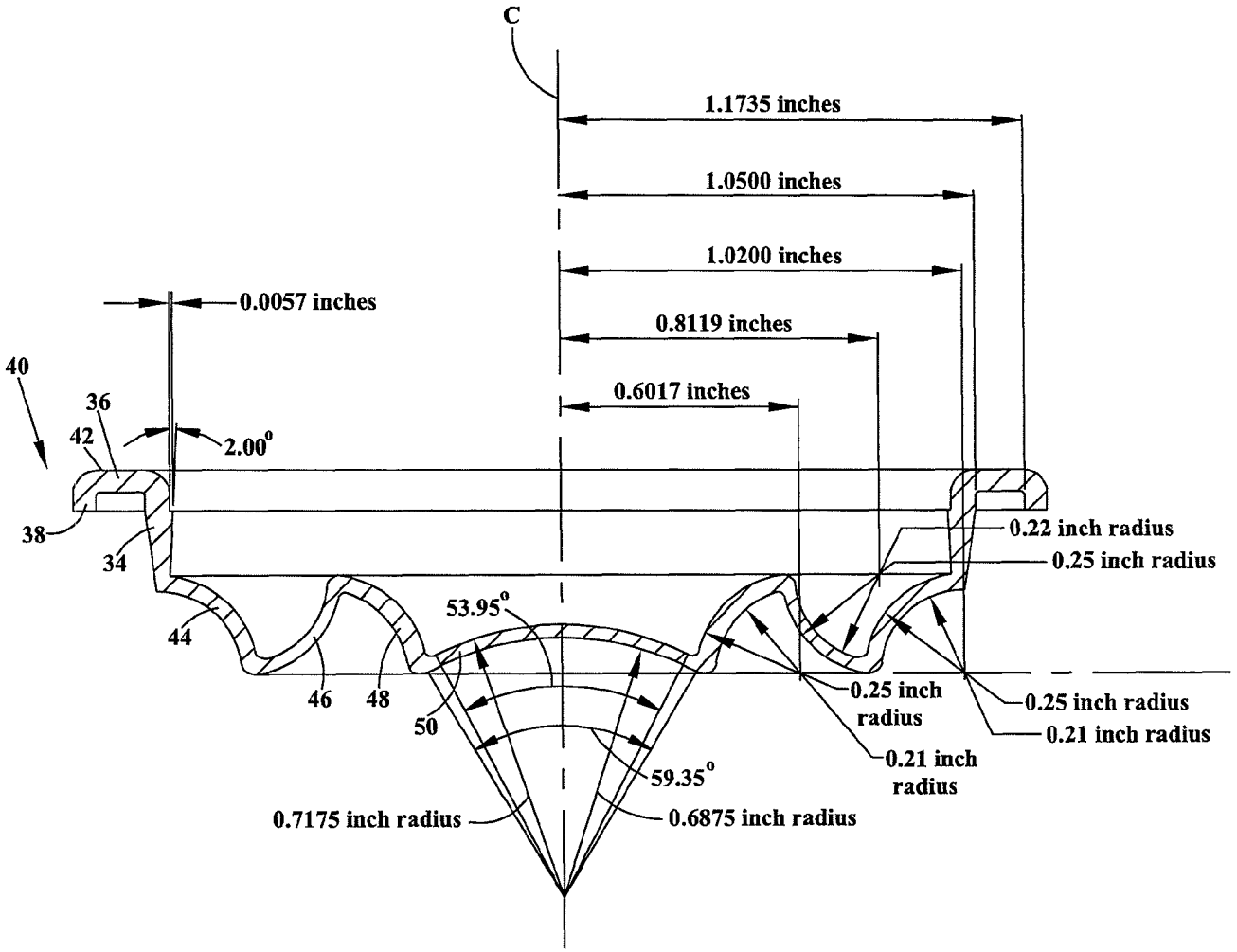
FIG. 2 is a cross-sectional view highlighting the first embodiment of the diaphragm illustrated in FIG. 1, including example dimensions and geometries.

FIG. 2 is a cross-sectional view of the first embodiment of the diaphragm 40 illustrated in FIG. 1. FIG. 2 shows the various elements that form the integral diaphragm 40 and provides example dimensions for the diaphragm 40. By "integral" is meant a single piece or a single unitary part that is complete by itself without additional pieces, i.e., the diaphragm 40 is of one monolithic piece formed as a unit. The particular dimensions and geometries (e.g., shapes) of the various elements are important to achieving the functions of the diaphragm 40 described below. The dimensions and geometries of the diaphragm 40 are predetermined by the application intended for the apparatus 10. By "predetermined" is meant determined beforehand, so that the predetermined characteristics of the diaphragm 40 are determined, i.e., chosen or at least known, before the diaphragm 40 is manufactured and incorporated into the apparatus 10.

Progressing from the outer edge toward the center, the diaphragm 40 begins with an edge 42 that may be in the form of a hook or inverted "J." The edge 42 is an integral component having three sections: a stem 34, a top seal ring 36, and a side seal 38. The edge 42 can hook over the top of the neck 22 of the container 20, as shown in FIG. 1, to position the diaphragm 40 relative to the container 20. The diaphragm 40 can then be pinned (and held in position) between the container 20 and the cap 30 when the cap 30 engages the container 20 and simultaneously pushed downward against the edge 42. The edge 42 can alternatively or in addition be affixed to either the container 20 or to the cap 30.

Following the edge 42 are a series of elements defining horizontal silfon tori segments connected to each other so that their geometries overlap. In the embodiment of the diaphragm 40 illustrated in FIGS. 1 and 2, the diaphragm 40 has three tori segments 44, 46, and 48. A "toroid" is a surface generated by a closed curve rotating about, but not intersecting or containing, an axis in its own plane. A "torus" is a toroid generated by a circle. "Tori" is the plural form of "torus." Each torus segment 44, 46, and 48 is positioned specifically and uniquely to compensate for forces applied to the diaphragm 40 during use.

From a vector forces analysis, the tori segments 44, 46, and 48 respond with lesser resistance to either positive or negative pressure that may develop inside of the container 20 during processing. No other kind of deformation of material of the diaphragm 40 is expected, except bending from momentum and rotation of the segments 44, 46, and 48 around an axis of resistance with minimal force. Therefore, the integrity of the construction is preserved and the ready response to positive or negative forces is assured.

Following the tori segments 44, 46, and 48 of the diaphragm 40 is a central deflector button 50. The deflector button 50 of the embodiment illustrated in FIGS. 1 and 2 is concave. In its entirety, the diaphragm 40 has five elements (edge 42; tori segments 44, 46, and 48; and deflector button 50) that balance equally positive and negative pressure deviation through movements of the elements both vertically and horizontally.

Specific geometric features of the embodiment of the diaphragm 40 shown in FIGS. 1 and 2 are highlighted as follows. First, the radii of the tori segments 44, 46, and 48 are substantially equal. Second, the thickness of the tori segments 44, 46, and 48 varies from thicker to thinner to thicker to promote the response of the diaphragm 40 to a vacuum and to resist positive pressure inside of the container 20. Third, the deflector button 50 is thinner than the tori segments 44, 46, and 48. The diaphragm 40 of this embodiment displaces about one third (⅓) of the head space in its neutral position, and about one half (½) of the head space when fully engaged.

Figure 4:
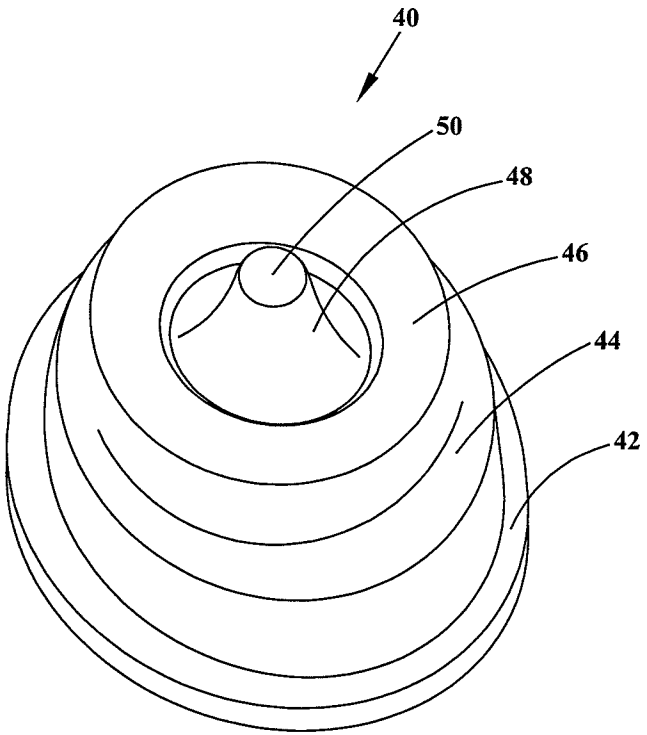
FIG. 4 is a perspective view of an example diaphragm of the present invention with a convex pressure-compensating center deflector button.
Figure 3:
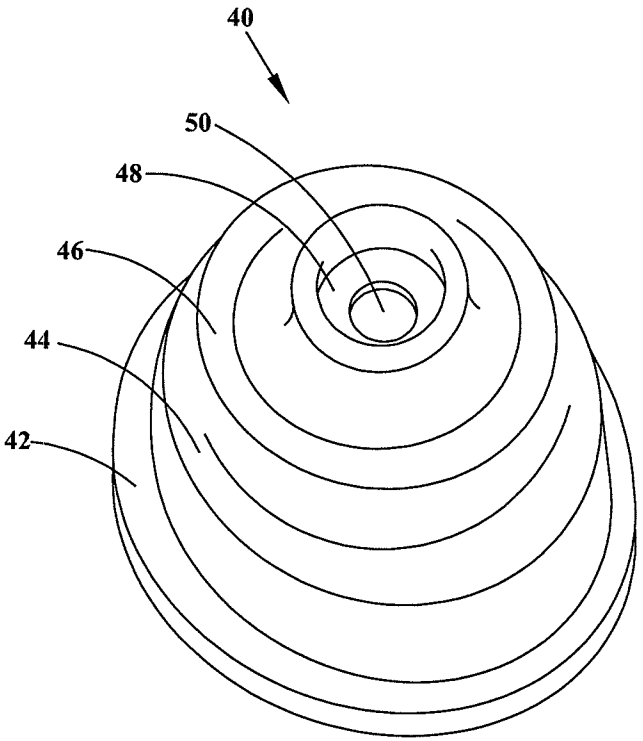
FIG. 3 is a perspective view of an example diaphragm of the present invention with a concave pressure-compensating center deflector button.

FIGS. 3 and 4 illustrate two alternatives for the deflector button 50 in the context of the diaphragm 40. FIG. 3 is a perspective view of the diaphragm 40 illustrated in FIGS. 1 and 2, showing the concave pressure-compensating center deflector button 50. FIG. 4 is a perspective view of the diaphragm 40, showing an alternative convex pressure-compensating center deflector button 50.

Figure 5:
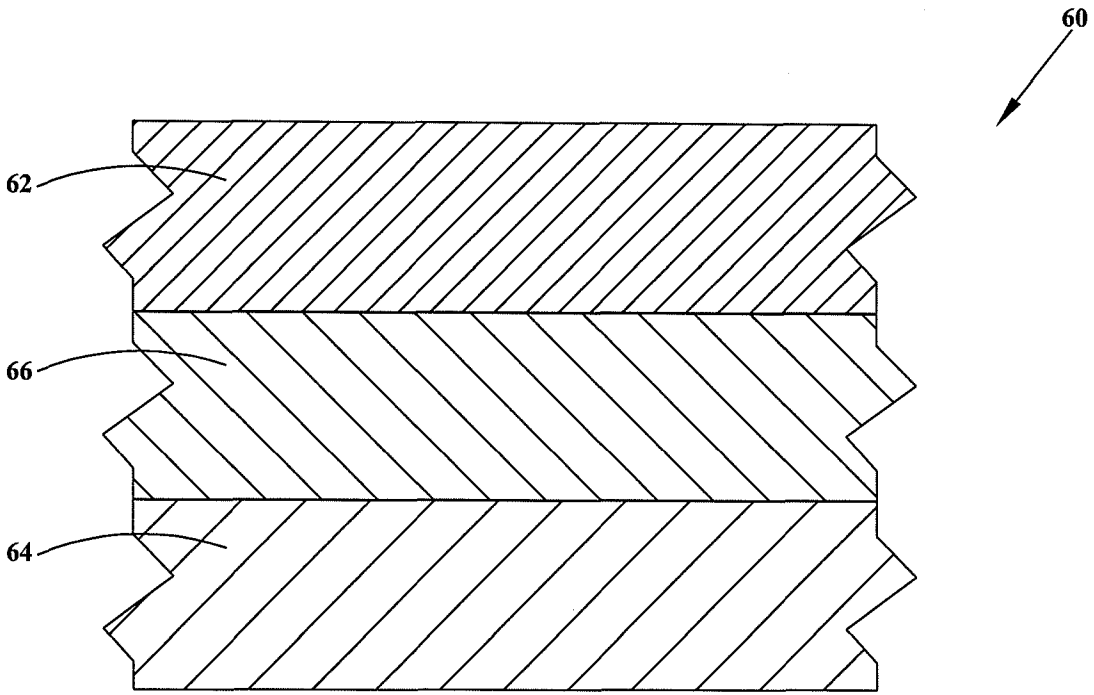
FIG. 5 is a schematic illustration of an example multi-layered film used to construct the diaphragm.

The diaphragm 40 may be constructed of a single-layer film formed by a thermoforming method, injection or compression molding methods, or a combination of such methods. The diaphragm 40 may be comprised of polymer or a blend of polymers. Preferably, the diaphragm 40 is constructed of a multi-layer film 60 as shown in FIG. 5. In the example of FIG. 5, the film 60 has three layers although, of course, more or fewer than three layers could form the film 60 as would be known by an artisan. A first layer 62 is made of a thermoplastic elastomer to promote an air and liquid tight seal. A second layer 64 provides a physical plastic barrier against the ingress of fluids. And a third layer 66 is a polymer vehicle that may be used to carry physical or chemical foaming agents or a combination of such agents, a gas scavenger, or a combination of several anti-oxidation additives. Other appropriate additives and components can be incorporated in the third layer 66 without departing from the scope of the present invention. The thickness, order, and orientation of the layers 62, 64, and 66 are predetermined and can vary depending upon the application.

The diaphragm 40 is formed of alternating concave and convex surfaces defined by the tori segments 44, 46, and 48 and by the deflector button 50. Each surface may resemble a portion of a toroid surface with the constant diameter of a first circle, or an alternating part of a cycloid that may be a form of an inverted circle with a variable or constant diameter, or part of an elliptic toroid surface, or an alternating involute toroid surface, or any toroid surface derived from the rotation of algebraic, trigonometric, differential geometric, or integrated geometric curves. The surfaces alternate so that the segmental vectors of stresses and momentums applied to the diaphragm 40 during the processes of manufacturing and sealing the apparatus 10 generally compensate each other as in the equilibrated second-order tensor.

Within the range of elastic deformation that occurs under the action of internal pressure or vacuum and that translates into a force from normal axial load, bending, and torque proportionally to the area of the tori segments 44, 46, and 48, the diaphragm 40 reacts by deflecting each segment independently with respect to the magnitude of the load and proportional to the area of the segments. The central deflector button 50 of the diaphragm 40 is formed to compensate for the predominant forces generated inside of the container 20 during the process of manufacture.

In a hot-fill application when the temperature of the retained or packaged product 24 reaches about 205° F. or less and the duration of this exposure generally does not exceed about 10 minutes before the cooling process starts, the center deflector button 50 of the diaphragm 40 partially absorbs load and further partially transfers that load to the adjacent (first) torus segment 48. The first torus segment 48 also partially absorbs its own load proportional to the area of the elements and transferred load, and further partially transfers load to the second torus segment 46, and so forth. The distributed loads result in strain and bending of the center deflector button 50 and of the tori segments 44, 46, and 48 in accordance with the sign (positive or negative) of the load.

In other applications, such as a pasteurizing application, the packaged product 24 can reach temperatures greater than 205° F. and up to about 230° F. The duration of exposure to this temperature can be up to about 30 minutes before the cooling process starts. The diaphragm 40 absorbs loads, in such applications, in extension as required to protect the container 20 from excessive deformation imposed by the manufacturing processes.

When the container 20 is filled with a hot product 24 and sealed, the internal pressure of the container 20 below the diaphragm 40 rises due to evaporation of the contained fluids. The internal pressure is equally distributed throughout the inner area of the container 20, and the diaphragm 40 both absorbs load and yields first because it is designed to be less dynamically resilient than the container 20. Revolution of the tori segments 44, 46, and 48 promotes load absorption and outward motion of the diaphragm 40, increasing the actual volume of the container 20 and therefore reducing the pressure inside of the container 20 and the stress on the walls of the container 20. Under the pressure, the stem 34 moves inward further increasing the volume of the second chamber 14 and assisting to reduce pressure and stress. The air and liquid tight seal, developed when the cap 30 and the diaphragm 40 engage the container 20, is maintained by engagement of at least the top seal ring 36 and the side seal 38 with the container 20.

In the high-temperature equilibrium conditions that occur during hot-fill or pasteurization operations, the pressure in the second chamber 14 is equalized to the pressure in the first chamber 12 minus the stresses absorbed by the diaphragm 40 itself. The pressure load in the second chamber 14 comprises mostly the partial pressure of vapors while the pressure in the first chamber 12 comprises mostly compressed atmospheric gases. Therefore, in high-temperature equilibrium conditions there is no natural ingress of the atmospheric gases through the cap 30 and the diaphragm 40.

Once the sealed container 20 is exposed to cooling, the vapors in the second chamber 14 condense. Therefore, the pressure in the second chamber 14 begins to decrease. The load applied to the diaphragm 40 reverses, forcing the diaphragm 40 initially to absorb load and then to move inversely. While the pressure decreases, the (last) torus segment 44 farthest from the center deflector button 50 (i.e., the n-th order segment, where n=3 in the embodiment illustrated in FIGS. 1 and 2) reacts elastically after the reversed load is released such that the resistance of the torus segment 44 is overcome. The torus segment 44 partially absorbs the load and partially transfers the load to the next torus segment 46 (i.e., the (n−1)-th order segment) where the load is partially absorbed and partially transferred as well, and so forth.

Under normal atmospheric conditions, the vacuum pressure in the second chamber 14 is equal to the vacuum pressure in the first chamber 12 plus the stresses absorbed by the diaphragm 40 itself. The atmosphere in the second chamber 14 comprises mostly atmospheric gases with residual vapors from the product 24 while the atmosphere in the first chamber 12 comprises atmospheric gases only—all pasteurized as intended. Neither the diaphragm 40 nor the cap 30 used to close and seal the container 20 have any vents, openings, voids, apertures, holes, or passages. Nor do the diaphragm 40 or the cap 30 have any other mechanism to pass fluids into the container 20 or into the chambers 12, 14 after closure. By eliminating such conventional mechanisms, the apparatus 10 avoids tamper problems, the introduction of bacteria, and the potential spoilage of the product 24.

Further, the physical plastic barrier provided by the second layer 64 of the film 60 used to construct the diaphragm 40 restricts ingress of atmospheric gases through the diaphragm 40 and into the container 20. The gas-scavenging composition incorporated into the third layer 66 absorbs any gases that might remain in the container 20 or diffuse through the cap 30 into the container 20. Active gas scavengers may absorb gases that remain in the head space, further reducing product spoilage or oxidation.

Neither the top seal ring 36 nor the side seal 38 are involved in the stress-strain compensation. Thus, the air and liquid tight seal remains constant and stable during the cooling operation. Further promoted by the atmosphere present under the diaphragm 40, the air and liquid tight seal is preserved during the entire desired shelf life of the sealed container 20 and its retained product 24.

The diaphragm 40 is formed to respond to the vacuum inside of the container 20, partially absorbing the load within the elastic deformation range of the material of the diaphragm 40 and partially deflecting inversely. In this condition the tori segments 44, 46, and 48 of the diaphragm 40 promote a dual audible effect. When the closing cap 30 is first rotated to open the container 20, the cap 30 is partially disengaged from the diaphragm 40. Such partial disengagement produces a first audible effect emanating from the first chamber 12. At this point, the diaphragm 40 may remain affixed to the container 20 or to the cap 30 thereby preserving the vacuum in the second chamber 14. Later, the user may remove the diaphragm 40 along with closure cap 30 or independently from the cap 30, depending on the design of the cap 30, thus producing the second audible effect. The second audible effect emanates from the second chamber 14.

A first embodiment of the diaphragm 40 is illustrated in FIGS. 1 and 2. FIGS. 6, 7, 8, 9, 10, 11, and 12 illustrate additional embodiments of the diaphragm 40. Turning to the embodiment shown in FIG. 6, the diaphragm **40*a* has three tori segments 44*a*, 46*a*, and 48*a* that are reversed relative to the corresponding tori segments 44, 46, and 48 of the diaphragm 40 illustrated in FIGS. 1 and 2. The diaphragm 40*a* also has a smaller central deflector button 50*a* than the deflector button 50 of the diaphragm 40**.

Figure 6:
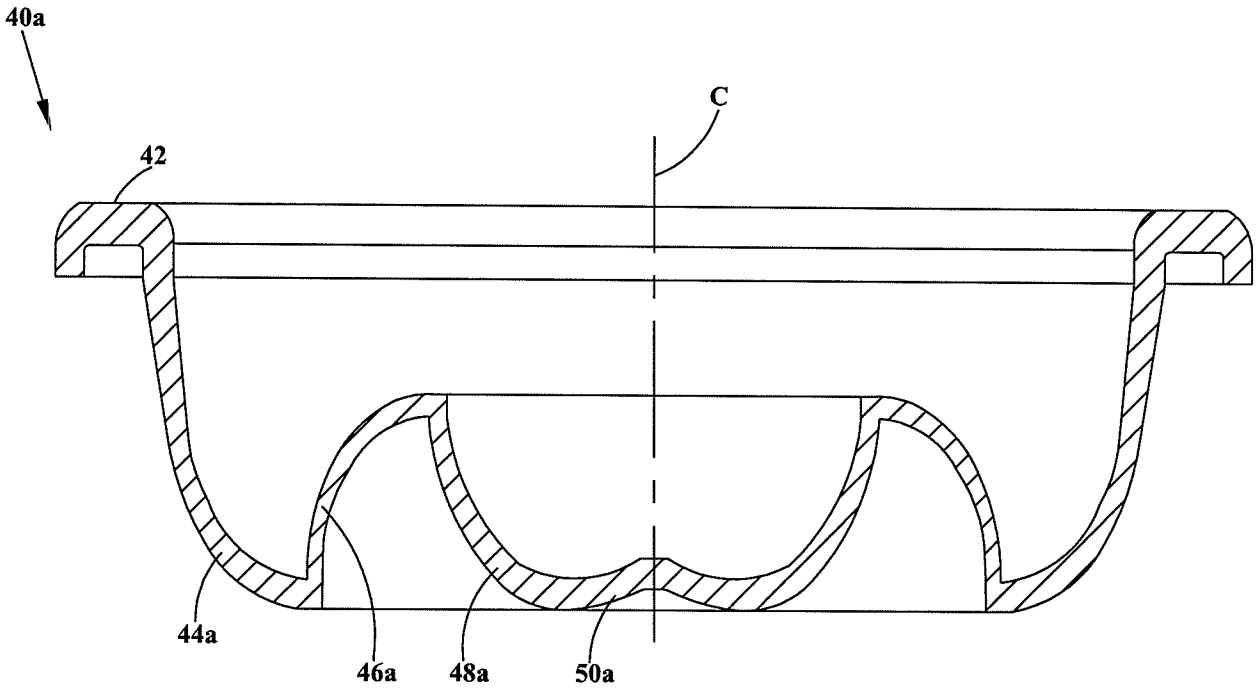
FIG. 6 is a cross-sectional view of a diaphragm according to another example embodiment of the present invention.

Specific geometric features of the embodiment of the diaphragm **40*a* shown in FIG. 6 are highlighted as follows. First, the radii of the tori segments 44*a*, 46*a*, and 48*a* are substantially equal. Second, the thicknesses of the tori segments 44*a*, 46*a*, and 48*a* vary from thicker to thinner to thicker to promote the response of the diaphragm 40*a* to a vacuum and to resist positive pressure inside of the container 20. Third, the deflector button 50*a* is smaller and thicker than the tori segments 44*a*, 46*a*, and 48*a*. The diaphragm 40*a*** of this embodiment displaces more than ⅓ of the head space in its neutral position, and more than ½ of the head space when fully engaged.

Figure 7:
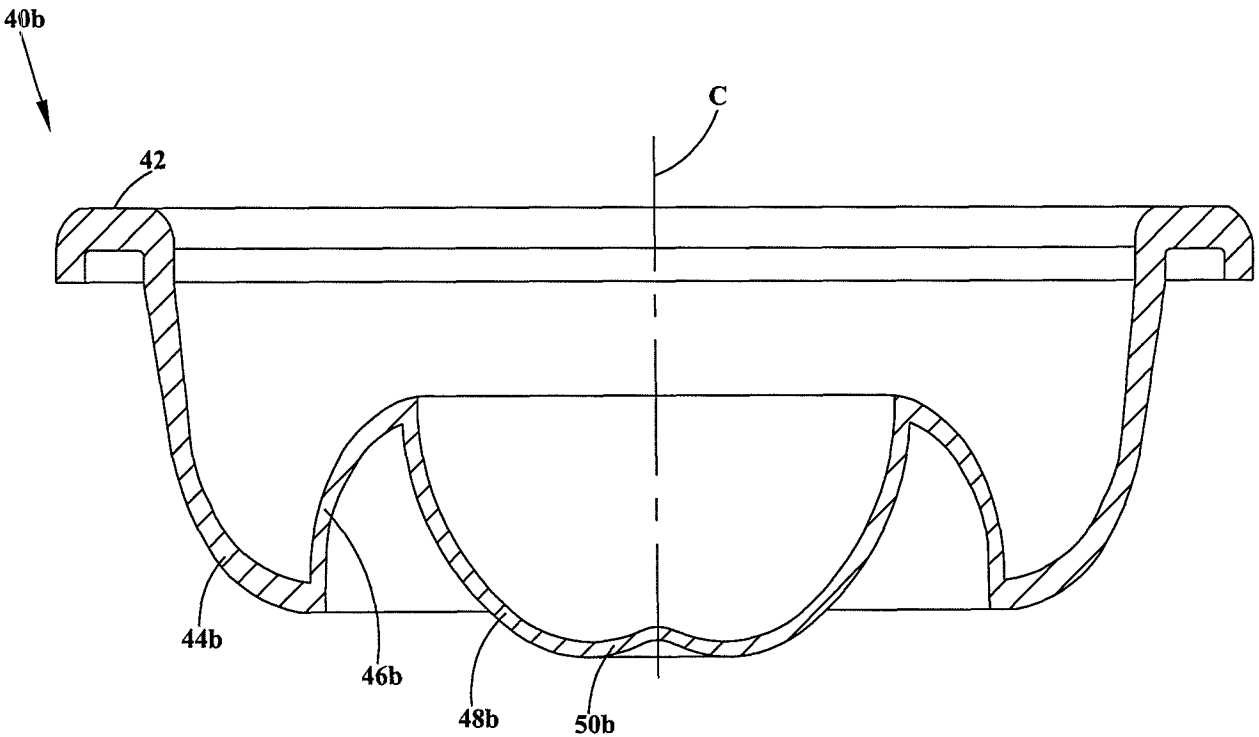
FIG. 7 is a cross-sectional view of a diaphragm according to yet another example embodiment of the present invention.

Turning to the embodiment shown in FIG. 7, the diaphragm **40*b* has three tori segments 44*b*, 46*b*, and 48*b* that are reversed relative to the corresponding tori segments 44, 46, and 48 of the diaphragm 40. The tori segments 44*b*, 46*b*, and 48*b* have radii that increase from torus segment 44*b* to torus segment 46*b* to torus segment 48*b*. The diaphragm 40*b* also has a smaller central deflector button 50*b* than both (i) the deflector button 50 of the diaphragm 40, and (ii) the tori segments 44*b*, 46*b*, and 48*b***.

Specific geometric features of the embodiment of the diaphragm **40*b* shown in FIG. 7 are highlighted as follows. First, the radii of the tori segments 44*b*, 46*b*, and 48*b* increase from 0.20 inches to 0.30 inches to 0.40 inches, respectively. Second, the thicknesses of the tori segments 44*b*, 46*b*, and 48*b* are equal to each other and are also equal to the thickness of the deflector button 50*b*. Third, the deflector button 50*b* is smaller than the tori segments 44*b*, 46*b*, and 48*b*. The diaphragm 40*b*** of this embodiment displaces about ½ of the head space in its neutral position, and more than ½ of the head space when fully engaged.

Figure 8:
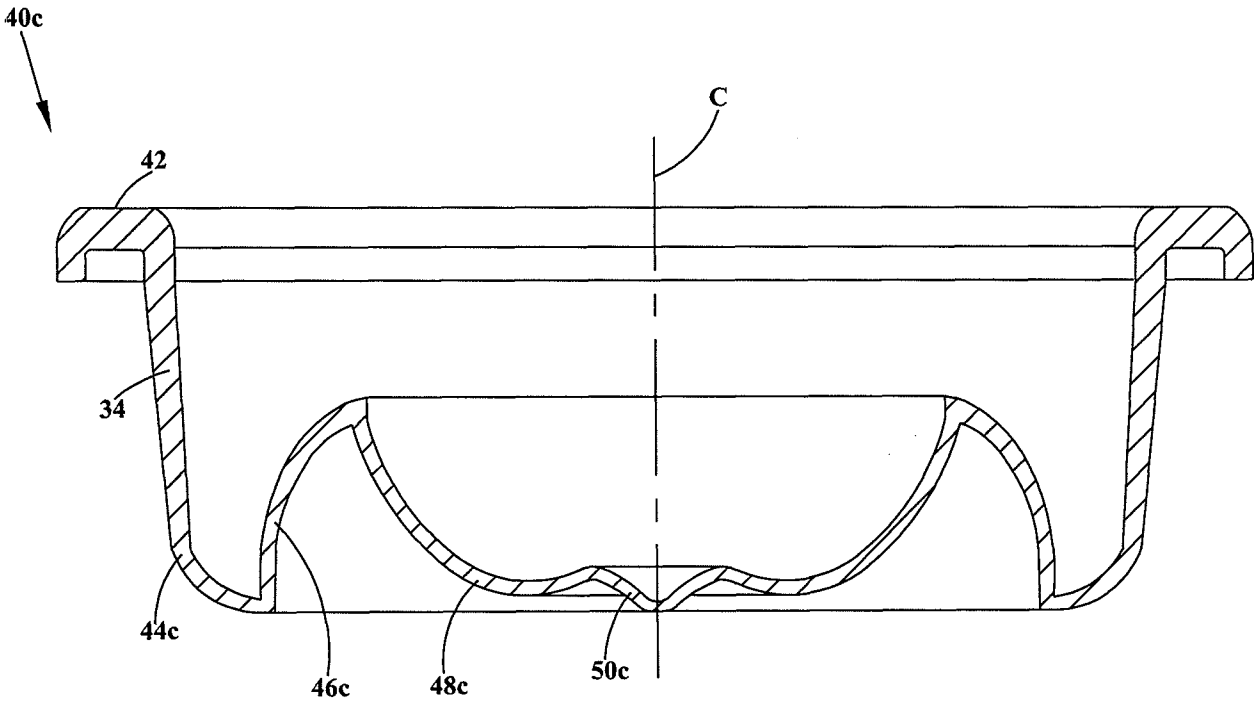
FIG. 8 is a cross-sectional view of a diaphragm according to yet another example embodiment of the present invention.

Turning to the embodiment shown in FIG. 8, the diaphragm **40*c* has three tori segments 44*c*, 46*c*, and 48*c* that are reversed relative to the corresponding tori segments 44, 46, and 48 of the diaphragm 40. The tori segments 44***c*, 46*c*, and 48*c* have radii that increase from torus segment 44*c* to torus segment 46*c* to torus segment 48*c*. The diaphragm 40*c* also has a smaller central deflector button 50*c* than both (i) the deflector button 50 of the diaphragm 40, and (ii) the tori segments 44*c*, 46*c*, and 48*c*. The deflector button 50*c* is convex rather than concave.

Specific geometric features of the embodiment of the diaphragm 40*c* shown in FIG. 8 are highlighted as follows. First, the radii of the tori segments 46*c* and 48*c* are increased relative to the corresponding tori segments 46 and 48; the radius of the torus segment 44*c* is reduced relative to the corresponding torus segment 44. Second, the thicknesses of the tori segments 44*c*, 46*c*, and 48*c* are equal to each other and are also equal to the thickness of the deflector button 50*c*. Third, the deflector button 50*c* is reversed (convex) relative to the deflector button 50 to resist higher pressure inside of the container 20. The diaphragm 40*c* of this embodiment displaces more than ½ of the head space in its neutral position, and more than ½ of the head space when fully engaged. Finally, the edge 42 has a longer stem 34 than the corresponding element of the diaphragm 40 due to a higher draw.

Figure 9:
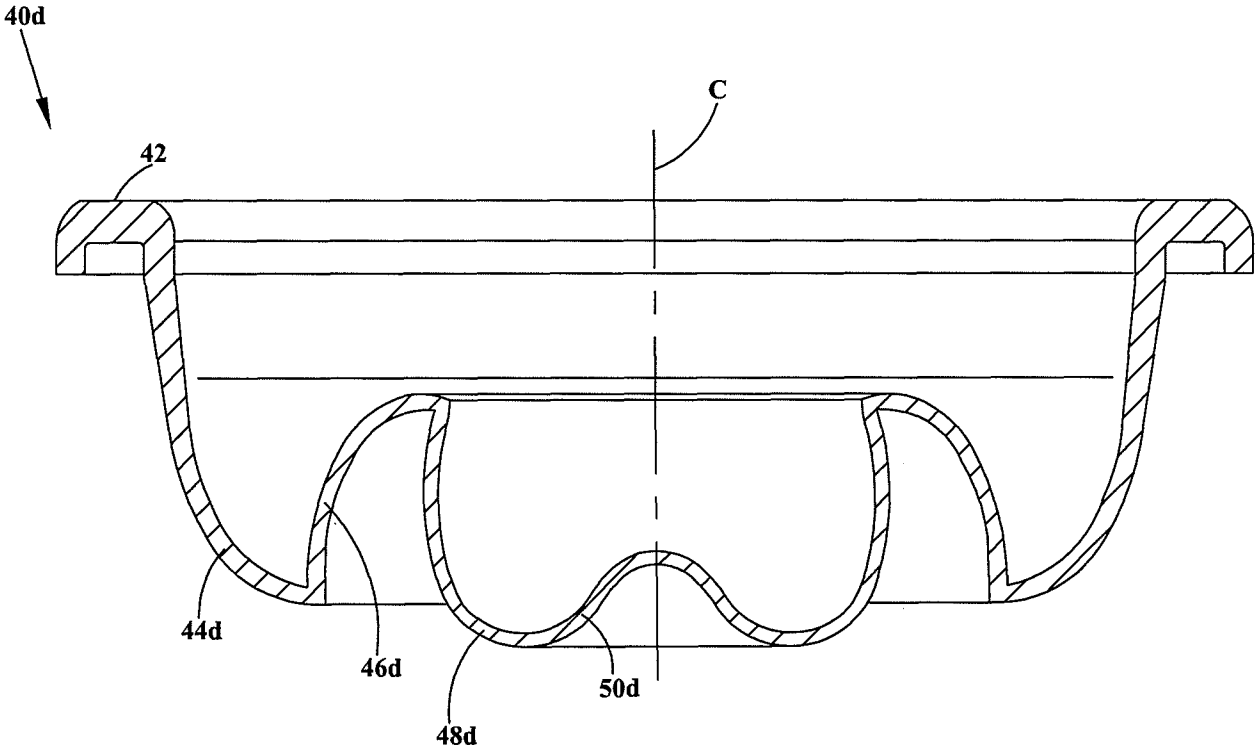
FIG. 9 is a cross-sectional view of a diaphragm according to yet another example embodiment of the present invention.

Turning to the embodiment shown in FIG. 9, the diaphragm 40*d* has three tori segments 44*d*, 46*d*, and 48*d* that are reversed relative to the corresponding tori segments 44, 46, and 48 of the diaphragm 40. The tori segments 44*d*, 46*d*, and 48*d* are set on a 1:11 slope. The diaphragm 40*d* also has a deeper central deflector button 50*d* than the deflector button 50 of the diaphragm 40.

Specific geometric features of the embodiment of the diaphragm 40*d* shown in FIG. 9 are highlighted as follows. First, the radii of the tori segments 44*d*, 46*d*, and 48*d* are substantially equal. Second, the tori segments 44*d*, 46*d*, and 48*d* are allocated at an angle of about 10 degrees, altitude declaration, from the centerline or center of symmetry "C." Third, the thicknesses of the tori segments 44*d*, 46*d*, and 48*d* are equal to each other and are also equal to the thickness of the deflector button 50*d*. Fourth, the deflector button 50*d* is smaller than the tori segments 44*d*, 46*d*, and 48*d* but is deeper to provide additional pressure-motion compensation. The diaphragm 40*d* of this embodiment displaces more than ½ of the head space in its neutral position, and more than ½ of the head space when fully engaged.

Figure 10:
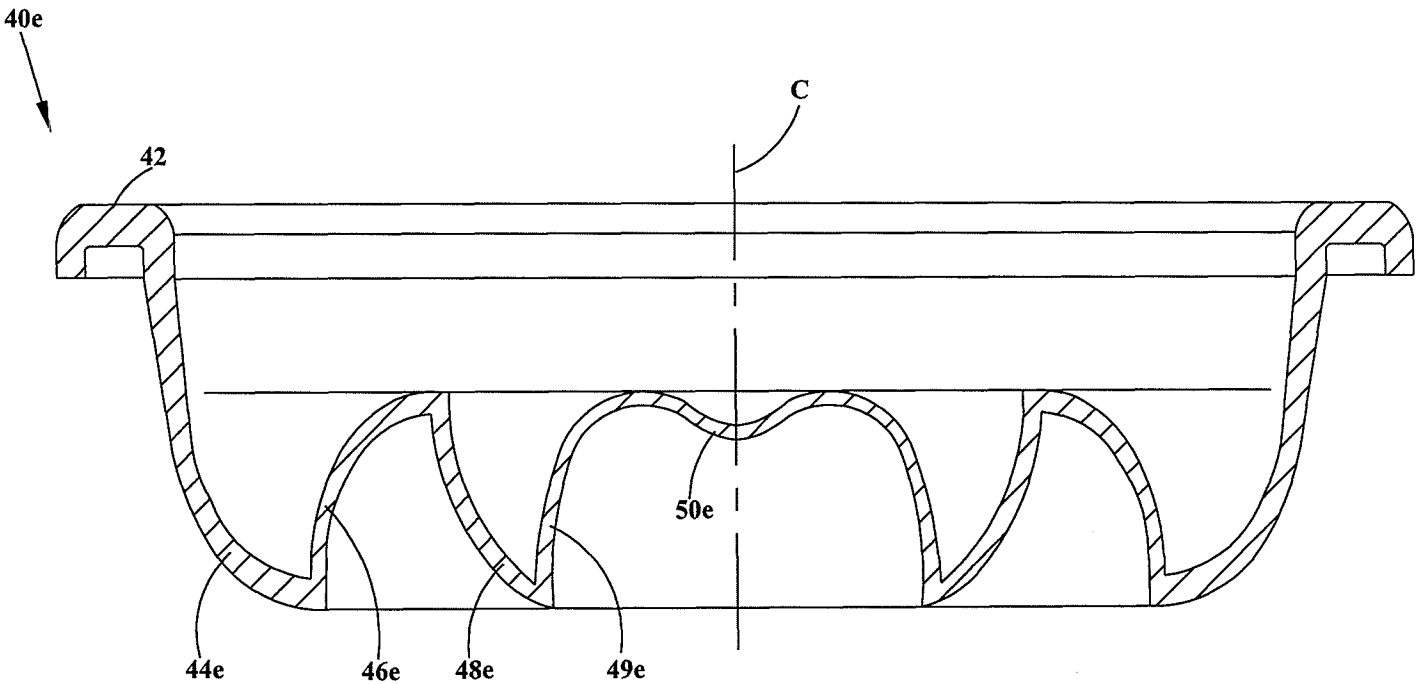
FIG. 10 is a cross-sectional view of a diaphragm according to yet another example embodiment of the present invention.

Turning to the embodiment shown in FIG. 10, the diaphragm 40*e* has four tori segments 44*e*, 46*e*, 48*e*, and 49*e* that are reversed relative to the corresponding tori segments 44, 46, and 48 of the diaphragm 40. The diaphragm 40*e* also has a smaller central deflector button 50*e* than both (i) the deflector button 50 of the diaphragm 40, and (ii) the tori segments 44*e*, 46*e*, 48*e*, and 49*e*. The deflector button 50*e* is convex rather than concave.

Specific geometric features of the embodiment of the diaphragm 40*e* shown in FIG. 10 are highlighted as follows. First, the radii of the tori segments 44*e*, 46*e*, 48*e*, and 49*e* are substantially equal. Second, four tori segments 44*e*, 46*e*, 48*e*, and 49*e* are provided (rather than three as in previous embodiments) to increase the pressure-motion response. Third, the thicknesses of the tori segments 44*e*, 46*e*, 48*e*, and 49*e* are equal to each other and are also equal to the thickness of the deflector button 50*e*. Fourth, the deflector button 50*e* is smaller than the tori segments 44*e*, 46*e*, 48*e*, and 49*e*. The diaphragm 40*e* of this embodiment displaces more than ½ of the head space in its neutral position, and more than three quarters (¾) of the head space when fully engaged.

Figure 11:
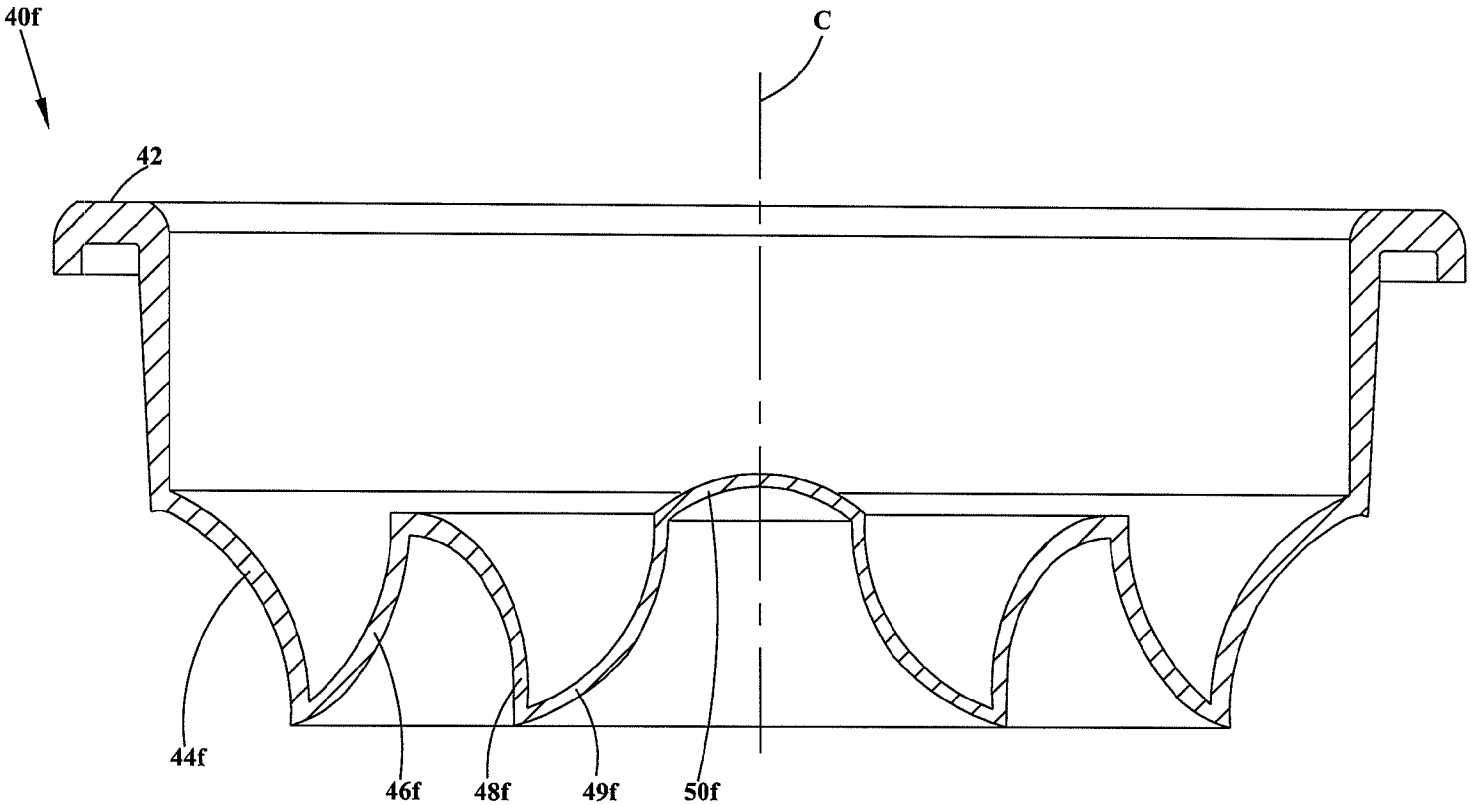
FIG. 11 is a cross-sectional view of a diaphragm according to yet another example embodiment of the present invention.

Turning to the embodiment shown in FIG. 11, the diaphragm 40*f* has four tori segments 44*f*, 46*f*, 48*f*, and 49*f* that are oriented as are the corresponding tori segments 44, 46, and 48 of the diaphragm 40. The diaphragm 40*f* also has a larger central deflector button 50*f* than the deflector button 50 of the diaphragm 40.

Specific geometric features of the embodiment of the diaphragm 40*f* shown in FIG. 11 are highlighted as follows. First, the radii of the tori segments 44*f*, 46*f*, 48*f*, and 49*f* are substantially equal. Second, four tori segments 44*f*, 46*f*, 48*f*, and 49*f* are provided (rather than three as in all but one of the previous embodiments) to increase the pressure-motion response. Third, the thicknesses of the tori segments 44*f*, 46*f*, 48*f*, and 49*f* are equal to each other and are also equal to the thickness of the deflector button 50*f*. Fourth, the deflector button 50*f* is larger than the tori segments 44*f*, 46*f*, 48*f*, and 49*f* to provide additional vacuum compensation. The diaphragm 40*f* of this embodiment displaces more than ½ of the head space in its neutral position, and more than ¾ of the head space when fully engaged.

Figure 12:
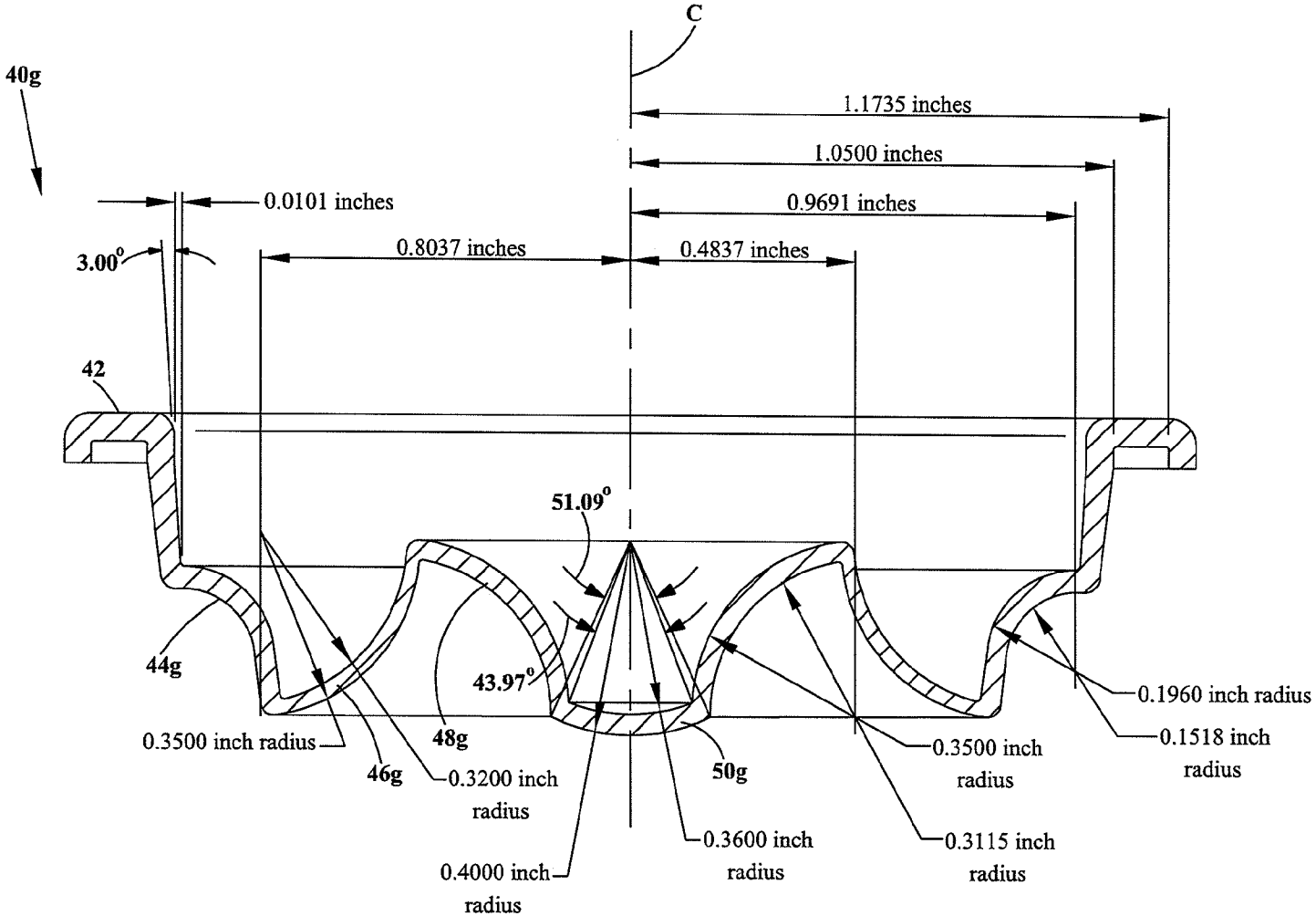
FIG. 12 is a cross-sectional view of another embodiment of the diaphragm, which is a variation of the first embodiment of the diaphragm illustrated in FIGS. 1 and 2.

FIG. 12 is a cross-sectional view of another embodiment of the diaphragm 40*g*, which is a variation of the first embodiment of the diaphragm 40 illustrated in FIGS. 1 and 2. FIG. 12 shows the various elements that form the integral diaphragm 40*g* and provides example dimensions for the diaphragm 40*g*. The diaphragm 40*g* has three segments 44*g*, 46*g*, and 48*g* that are oriented as are the corresponding tori segments 44, 46, and 48 of the diaphragm 40. The diaphragm 40*g* also has a larger central deflector button 50*g* than the deflector button 50 of the diaphragm 40. The deflector button 50*g* is convex rather than concave.

Specific geometric features of the embodiment of the diaphragm 40*g* shown in FIG. 12 are highlighted as follows. First, the outermost segment 44*g* resembles a second degree polynomial curve to increase the pressure-motion response in the horizontal plane. The middle torus segment 46*g* and the innermost torus segment 48*g* have radii that are enlarged, relative to the radii of the corresponding tori segments 46 and 48 of the diaphragm 40, to increase the pressure-motion response in the transverse direction. The thicknesses of the segments 44*g*, 46*g*, and 48*g* vary from thicker to thinner to thicker. The larger central deflector button 50*g* provides additional pressure compensation. The diaphragm 40*g* of this embodiment displaces more than ½ of the head space in its neutral position, and about ¾ of the head space when fully engaged.

EXAMPLES

The following examples are included to more clearly demonstrate the overall nature of the invention. These examples are exemplary, not restrictive, of the invention. Two prototype diaphragms 40, one made of a single-layer polyurethane resin with a durometer of Shore A 70-75 and the second made of a polypropylene-like thermoplastic with a durometer of Shore A 90-95, were tested in a simulated hot-fill application with subsequent vacuum chamber evaluation.

All specimens were responding to pressure developed inside of the container 20 in the full spectra of motion. The dimple effect on the standard polypropylene cap 30 equipped with the polyurethane prototype did not exceeded 0.020 inches. The test was done with 205° F. water filling a 45 oz container 20 followed by cooling in 60° F. water. Measurements of the roundness of the shoulder bends yielded the following results:

| | Diaphragm 40, FIG. 2 | Diaphragm 40g, FIG. 12 | Diaphragm 40f, FIG. 11 |
|---|---|---|---|
| Min, in | 4.1265 | 4.1620 | 4.1930 |
| Max, in | 4.3430 | 4.2880 | 4.2420 |
| Δ Ø, in | 0.2165 | 0.1260 | 0.0490 |
| % Change | 4.99% | 2.94% | 1.16% |

Head space displacements measured on the 45 oz container 20 yielded the following results:

| | Diaphragm 40, FIG. 2 | Diaphragm 40g, FIG. 12 | Diaphragm 40f, FIG. 11 |
|---|---|---|---|
| Max displacement w/PU prototype, cc | 35 | 52 | 60 |
| Min displacement w/PP prototype, cc | n/a | 28 | 35 |
| Initial, by design, cc | 20 | 23 | 24 |

From the data, the four-segment diaphragm 40*f* of FIG. 11 demonstrated the best pressure compensation features with the highest head space displacement.

The ability to seal was also evaluated in a simulated hot-fill application. Under laboratory conditions all polyurethane specimens retained an air-tight seal. The seal survived at least six pressurize/depressurize cycles in the vacuum chamber with both a composite and a single-piece closure diaphragm. The polypropylene prototypes were not tested for sealability.

Neither of the prototypes truly resembled the film 60 contemplated for the construction of the diaphragm 40. Polyurethane simulates only the surface layer hardness evaluated for its ability to seal while the polypropylene prototype simulates the worst-case hardness of the diaphragm 40 in a cold-case filling. Thus, the response of the actual diaphragm 40 to stresses may be different from the responses observed and is expected to be somewhat between the two prototypes.

The four-segment diaphragm 40*f* demonstrated the maximum 60 cc head space displacement, highest among the tested prototypes. The same four-segment diaphragm 40*f* demonstrated pressure-motion compensation at the lowest pressure contributing to minimal container deformation, about 1% while the diaphragm 40 yields 5% and the diaphragm 40*g* yields about 3% measured at the shoulder bend. The four-segment diaphragm 40*f* is recommended as the most promising design, pending further testing.

The diaphragm of the various embodiments and prototypes described above can be placed underneath a standard cap to assure an air-tight and liquid-tight closure of a container and compensate for deviated pressure in the container through a dynamic response. Among its many advantages and attributes, the diaphragm offers a consistent and long-term seal: the diaphragm creates and maintains an air-tight and liquid-tight seal from the moment of closing throughout storage until opened by the end customer. Pressure compensation is another advantage. The diaphragm compensates for the effect of positive pressure and vacuum created during hot, warm, or cold filling; pasteurization; and retort processes. The diaphragm can compensate for at least 50% of the pressure effect, giving the designer flexibility to compensate for the remaining effect through characteristics of the cap and container or otherwise.

Still another advantage of the diaphragm is head space displacement. The diaphragm naturally displaces the head space air, allowing free motion with minimal restrictions, when pressure inside of the container changes. A further advantage of the diaphragm is oxygen absorption. The diaphragm contains a recipe that reduces oxidation of the product both by restricting the flow of oxygen through the diaphragm and by active oxygen absorption. Vocalization is still a further advantage. Upon removal of the diaphragm for the first time, the diaphragm generates a sound, click, or other audible indication giving the customer assurance that the container safely sealed the product against air and liquid exposure throughout its shelf life.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed:

1. A pressure-motion compensating diaphragm for air and liquid tight sealing, in combination with a cap, of a container having a neck and a top and a vertical centerline and housing a product having a top level below the diaphragm, wherein when the diaphragm is in an unstressed position, a cross-section of the diaphragm comprises:

an edge adapted to engage at least one of the cap and the container, positioning the diaphragm horizontally in the container proximate the neck of the container and under the cap;

a center deflector button; and a plurality of segments having substantially no straight portions extending from the edge to the center deflector button, each segment defined as a surface following a circle, and including a first segment having a concave surface with respect to the centerline and a second segment adjacent to the first segment and having a convex surface with respect to the centerline, the segments together defining an asymmetrical plurality of segments with a discrete transition peak between them, wherein in response to forces applied to the diaphragm and created by pressure changes inside the container that occur as the container is filled with the product by a filling process including one or more of filling, pasteurization, or cooling steps, the plurality of segments and the center deflector button translate the forces into motion to deflect the diagram into a stressed position.

2. The diaphragm as recited in claim 1 wherein the edge, center deflector button, and segments form an integral diaphragm.

3. The diaphragm as recited in claim 1, wherein the segments bend and rotate, both vertically and horizontally, as required to protect the container from deformation imposed during manufacturing processes.

4. The diaphragm as recited in claim 1, wherein the center deflector button is concave.

5. The diaphragm as recited in claim 1, wherein the center deflector button is convex.

6. The diaphragm as recited in claim 1, wherein the diaphragm is made of a multi-layered film.

7. The diaphragm as recited in claim 6, wherein the multi-layered film is a plastic film comprising:

a first layer promoting the air and liquid tight seal;

a second layer providing a physical barrier against the passage of fluids through the diaphragm and into the container; and a third layer carrying an additive selected from the group consisting of physical foaming agents, chemical foaming agents, gas scavengers, anti-oxidation agents, and a combination of such additives.

8. The diaphragm as recited in claim 1, wherein the edge of the diaphragm comprises:

a stem engaging a first of the plurality of segments and moving inward relative to the container to reduce pressure on the container;

a top seal ring engaging the top of the container to maintain the air and liquid tight seal; and a side seal engaging the neck of the container to maintain the air and liquid tight seal.

9. The diaphragm as recited in claim 1, wherein the diaphragm lacks any vents, openings, voids, apertures, holes, or passages that would permit fluid to pass into the container.

10. The diaphragm as recited in claim 1, wherein the diaphragm provides a dual audible effect, the first audible effect emanating from a first chamber between the cap and the diaphragm upon opening the cap and release of a first pressure differential, and the second audible effect emanating from a second chamber between the diaphragm and the top level of the product upon removing the diaphragm from the container and release of a second pressure differential.

11. An apparatus for releasably storing a product, the apparatus comprising:

a container having a neck, a top, and a vertical centerline, the container housing the product with the product having a top level;

a cap engaging the container to help form an air and liquid tight seal; and a diaphragm disposed in the container to help form the air and liquid tight seal, wherein when the diaphragm is in an unstressed position, a cross-section of the diaphragm has:

(a) an edge adapted to engage at least one of the cap and the container, positioning the diaphragm horizontally in the container proximate the neck of the container and under the cap, (b) a center deflector button, and (c) a plurality of segments having substantially no straight portions extending from the edge to the center deflector button, each segment defined as a surface following a circle, and including a first segment having a concave surface with respect to the centerline and a second segment adjacent to the first segment and having a convex surface with respect to the centerline, the segments together defining an asymmetrical plurality of segments with a discrete transition peak between them, wherein in response to forces applied to the diaphragm and created by pressure changes inside the container that occur as the container is filled with the product by a filling process including filling, pasteurization, or cooling steps, the plurality of segments and the center deflector button translate the forces into motion to deflect the diagram into a stressed position.

12. The apparatus as recited in claim 11 wherein the apparatus defines a first chamber between the cap and the diaphragm, a second chamber between the diaphragm and the top level of the product, and a head space between the top level of the product and the top of the container.

13. The apparatus as recited in claim 12 wherein the diaphragm displaces about one third of the head space in its neutral position and about one half of the head space during the filling process with the cap on the container.

14. The apparatus as recited in claim 12 wherein the diaphragm displaces more than one third of the head space in its neutral position and more than one half of the head space when fully engaged.

15. The apparatus as recited in claim 12 wherein the diaphragm displaces about one half of the head space in its neutral position and more than one half of the head space when fully engaged.

16. The apparatus as recited in claim 12 wherein the diaphragm displaces more than one half of the head space in its neutral position and more than one half of the head space when fully engaged.

17. The apparatus as recited in claim 12 wherein the diaphragm displaces more than one half of the head space in its neutral position and more than three quarters of the head space when fully engaged.

18. The apparatus as recited in claim 12 wherein the diaphragm displaces more than one half of the head space in its neutral position and about three quarters of the head space when fully engaged.

19. The apparatus as recited in claim 11 wherein the diaphragm is affixed to one of the cap or the container.

20. The apparatus as recited in claim 11 wherein the edge, center deflector button, and segments form an integral diaphragm and the diaphragm bends and rotates, both vertically and horizontally, to protect the container from deformation imposed during manufacturing processes.

* * * * *